US012313316B2

(12) United States Patent
Sasaki

(10) Patent No.: US 12,313,316 B2
(45) Date of Patent: May 27, 2025

(54) AIR CONDITIONER

(71) Applicant: FUJITSU GENERAL LIMITED, Kanagawa (JP)

(72) Inventor: Hiroshi Sasaki, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 207 days.

(21) Appl. No.: 18/010,949

(22) PCT Filed: Jul. 1, 2021

(86) PCT No.: PCT/JP2021/025010
§ 371 (c)(1),
(2) Date: Dec. 16, 2022

(87) PCT Pub. No.: WO2022/024660
PCT Pub. Date: Feb. 3, 2022

(65) Prior Publication Data

US 2023/0235933 A1 Jul. 27, 2023

(30) Foreign Application Priority Data

Jul. 29, 2020 (JP) ..... 2020-128371

(51) Int. Cl.
*F25B 49/02* (2006.01)

(52) U.S. Cl.
CPC ..... *F25B 49/02* (2013.01); *F25B 2500/19* (2013.01); *F25B 2500/24* (2013.01);
(Continued)

(58) Field of Classification Search
CPC ..... F25B 49/02; F25B 2500/19; F25B 2700/2103; F25B 2700/2106; F25B 2700/21152
See application file for complete search history.

(56) References Cited

U.S. PATENT DOCUMENTS 5,214,918 A 6/1993 Oguni et al.
5,623,834 A * 4/1997 Bahel ..... F25B 49/005 62/224

(Continued)

FOREIGN PATENT DOCUMENTS

JP 62-158966 7/1987
JP 3-186170 A 8/1991

(Continued)

OTHER PUBLICATIONS

Kimura, Refrigerant shortage prediction apparatus, refrigerant shortage prediction method, and program, 2016, Full Document (Year: 2016).*

(Continued)

*Primary Examiner* — Nael N Babaa
(74) *Attorney, Agent, or Firm* — Greenblum & Bernstein, P.L.C.

(57) ABSTRACT

An air conditioner has a refrigerant circuit filled with a predetermined amount of a refrigerant, the circuit being formed of an outdoor unit and an indoor unit connected to each other by refrigerant piping, the outdoor unit having a compressor, an outdoor heat exchanger, and an expansion valve, the indoor unit having an indoor heat exchanger. The conditioner has an estimation model that estimates an amount of remaining refrigerant remaining in the circuit by using at least rotation frequency of the compressor, refrigerant discharge temperature at the compressor, heat exchanger temperature, degree of opening of the expansion valve, and outside air temperature, of operation state quantities indicating operation states during operation. The indoor heat exchanger has a sensor that is provided at an indoor heat exchanger intermediate portion connecting a first indoor heat exchanger port and a second indoor heat exchanger port to each other.

9 Claims, 6 Drawing Sheets

(52) U.S. Cl.
CPC . *F25B 2700/171* (2013.01); *F25B 2700/2103* (2013.01); *F25B 2700/2106* (2013.01); *F25B 2700/21152* (2013.01)

(56) References Cited

U.S. PATENT DOCUMENTS

| | | | | |
|---|---|---|---|---|
| 2008/0209926 | A1 | 9/2008 | Matsuoka et al. | |
| 2018/0080692 | A1* | 3/2018 | Honda | F25B 13/00 |
| 2019/0362036 | A1 | 11/2019 | Zhang et al. | |
| 2021/0169740 | A1* | 6/2021 | Janzen | G06N 20/00 |

FOREIGN PATENT DOCUMENTS

| | | | | |
|---|---|---|---|---|
| JP | 11-182990 | A | 7/1999 | |
| JP | 2006-23072 | A | 1/2006 | |
| JP | 2008-96051 | A | 4/2008 | |
| JP | 2008-232579 | A | 10/2008 | |
| WO | WO-2017163294 | A1 * | 9/2017 | F25B 45/00 |

OTHER PUBLICATIONS

Australian Office Action received in AU Application No. 2021316340, dated Oct. 30, 2023.
International Search Report issued in International Bureau of WIPO Patent Application No. PCT/JP2021/025010, dated Aug. 10, 2021, along with an English translation thereof.
Extended European Search Report issued in European Patent Application No. 21848773.4, dated Feb. 26, 2024.

* cited by examiner

FIG.6

| REFRIGERANT FILLING RATE | OPERATION STATE QUANTITIES | |
|---|---|---|
| | COMPRESSOR ROTATION FREQUENCY | OTHERS (HEAT EXCHANGER TEMPERATURE, FAN ROTATION FREQUENCY, DEGREE OF OPENING OF EXPANSION VALVE, ETC.) |
| 100 | 20 TO 80 | a1,b1,c1,・・・・・・・・x1,y1,z1 |
| 80 | 20 TO 80 | a2,b2,c2,・・・・・・・・x2,y2,z2 |
| 40 | 20 TO 80 | a3,b3,c3,・・・・・・・・x3,y3,z3 |

FIG.7

| NORMAL/ ABNORMAL | OPERATION STATE QUANTITIES | |
|---|---|---|
| | COMPRESSOR ROTATION FREQUENCY | OTHERS (HEAT EXCHANGER TEMPERATURE, FAN ROTATION FREQUENCY, DEGREE OF OPENING OF EXPANSION VALVE, ETC.) |
| NORMAL | 20 TO 80 | a1,b1,c1,・・・・・・・・x1,y1,z1 |
| NORMAL | 20 TO 80 | a2,b2,c2,・・・・・・・・x2,y2,z2 |
| ABNORMAL | 20 TO 80 | a3,b3,c3,・・・・・・・・x3,y3,z3 |

AIR CONDITIONER

FIELD

The present invention relates to air conditioners.

BACKGROUND

An air conditioner that has been proposed determines an amount of refrigerant using an operation state quantity detectable at a refrigerant circuit. According to Patent Literature 1, for example, an amount of refrigerant is determined by use of a degree of supercooling at an outlet port of a condenser in a state (hereinafter, a default state) where a degree of superheat at an outlet port of an evaporator of a refrigerant circuit and pressure in the evaporator have been set at predetermined values in a cooling cycle.

CITATION LIST

Patent Literature

Patent Literature 1: Japanese Unexamined Patent Application Publication No. 2006-23072

SUMMARY

Technical Problem

Determining an amount of refrigerant in an air conditioner by using an operation state quantity, such as a degree of supercooling, requires a sensor for measuring the operation state quantity. For example, a business-use air conditioner that has a single outdoor unit and multiple indoor units connected to the single outdoor unit and that is placed in a large scale building, such as a commercial facility or an office building, has many sensors installed therein because of the need for controlling the multiple indoor units, and operation state quantities are thus able to be calculated using values from these sensors. For example, a degree of supercooling is able to be calculated using sensor values from temperature sensors at heat exchanger intermediate portions and heat exchanger outlet ports for each of indoor heat exchangers and outdoor heat exchanger therein.

However, the number of sensors installed in a home-use air conditioner, which has a single outdoor unit and a single indoor unit connected to the single outdoor unit and is mainly placed in a home, for example, is minimized within the range needed for the operation of the air conditioner in terms of cost reduction. For example, a home-use air conditioner may only have two temperature sensors in its indoor heat exchanger and outdoor heat exchanger, a sensor for detecting the temperature of the refrigerant at the intermediate portion of the indoor heat exchanger and a sensor for detecting the temperature of the refrigerant near the refrigerant outlet port of the outdoor heat exchanger, and in this case, the degree of supercooling at the outlet port of the condenser is unable to be calculated and the amount of refrigerant is thus unable to be determined using the degree of supercooling at the outlet port of the condenser.

There is thus a demand for a method of enabling an amount of refrigerant to be estimated even in an air conditioner having a limited number of sensors.

In view of such a problem, an object of the present invention is to provide an air conditioner that enables estimation of an amount of refrigerant remaining in its refrigerant circuit (hereinafter, an amount of remaining refrigerant) even in a case where the air conditioner has a limited number of sensors.

Solution to Problem

An air conditioner has a refrigerant circuit formed by connection of an outdoor unit and an indoor unit to each other by refrigerant piping. The outdoor unit has a compressor, an outdoor heat exchanger, and an expansion valve. The indoor unit has an indoor heat exchanger. The refrigerant circuit is filled with a predetermined amount of a refrigerant. The air conditioner includes a remaining refrigerant amount estimation model that estimates an amount of remaining refrigerant remaining in the refrigerant circuit by using at least rotation frequency of the compressor, refrigerant discharge temperature at the compressor, heat exchanger temperature, degree of opening of the expansion valve, and outside air temperature, of operation state quantities indicating operation states in air conditioning operation. The indoor heat exchanger includes a first indoor heat exchanger port portion where the refrigerant flows through; a second indoor heat exchanger port portion where the refrigerant flows through; an indoor heat exchanger intermediate portion connecting the first indoor heat exchanger port portion and the second indoor heat exchanger port portion to each other; and an indoor heat exchanger intermediate sensor that is provided at the indoor heat exchanger intermediate portion and detects temperature of the refrigerant passing through the indoor heat exchanger intermediate portion, the temperature being of the heat exchanger temperature. The outdoor heat exchanger includes: a first outdoor heat exchanger port portion where the refrigerant flow through; a second outdoor heat exchanger port portion where the refrigerant flows through; an outdoor heat exchanger intermediate portion connecting the first outdoor heat exchanger port portion and the second outdoor heat exchanger port portion to each other; and an outdoor heat exchanger outlet port sensor that is provided at the second outdoor heat exchanger port portion and detects temperature of the refrigerant passing through an outdoor heat exchanger outlet port in the second outdoor heat exchanger port portion in cooling operation, the temperature being of the heat exchanger temperature.

Advantageous Effects of Invention

In one aspect, an amount of remaining refrigerant is able to be estimated using a limited number of sensors.

BRIEF DESCRIPTION OF DRAWINGS

FIG. 6 is an explanatory diagram illustrating an example of training data used in multi-regression analysis.

FIG. 7 is an explanatory diagram illustrating an example of training data used in generation of an estimation model for classification of an amount of remaining refrigerant as normal or abnormal.

DESCRIPTION OF EMBODIMENTS

Embodiments disclosed by the present application, such as air conditioners, will hereinafter be described in detail on the basis of the drawings. Techniques disclosed herein are not to be limited by these embodiments. Furthermore, the embodiments described hereinafter may be modified as appropriate so long as no contradiction is caused by the modification.

First Embodiment

Configuration of Air Conditioner

Figure 1:
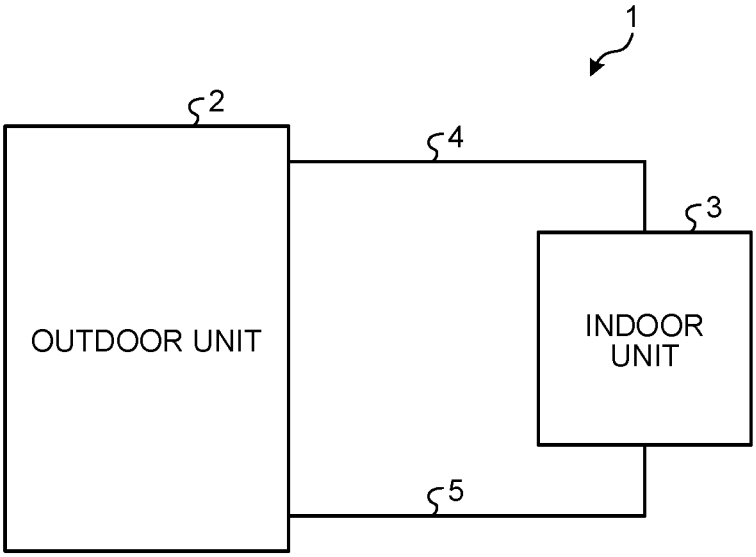
FIG. 1 is an explanatory diagram illustrating an example of an air conditioner of an embodiment.

FIG. 1 is an explanatory diagram illustrating an example of an air conditioner 1 of a first embodiment. The air conditioner 1 illustrated in FIG. 1 is, for example, a home-use air conditioner having a single outdoor unit 2 and a single indoor unit 3. The outdoor unit 2 is connected to the indoor unit 3 by a liquid pipe 4 and a gas pipe 5. This connection of the outdoor unit 2 and the indoor unit 3 by refrigerant piping including the liquid pipe 4 and the gas pipe 5 forms a refrigerant circuit 6 of the air conditioner 1.

Configuration of Outdoor Unit

Figure 2:
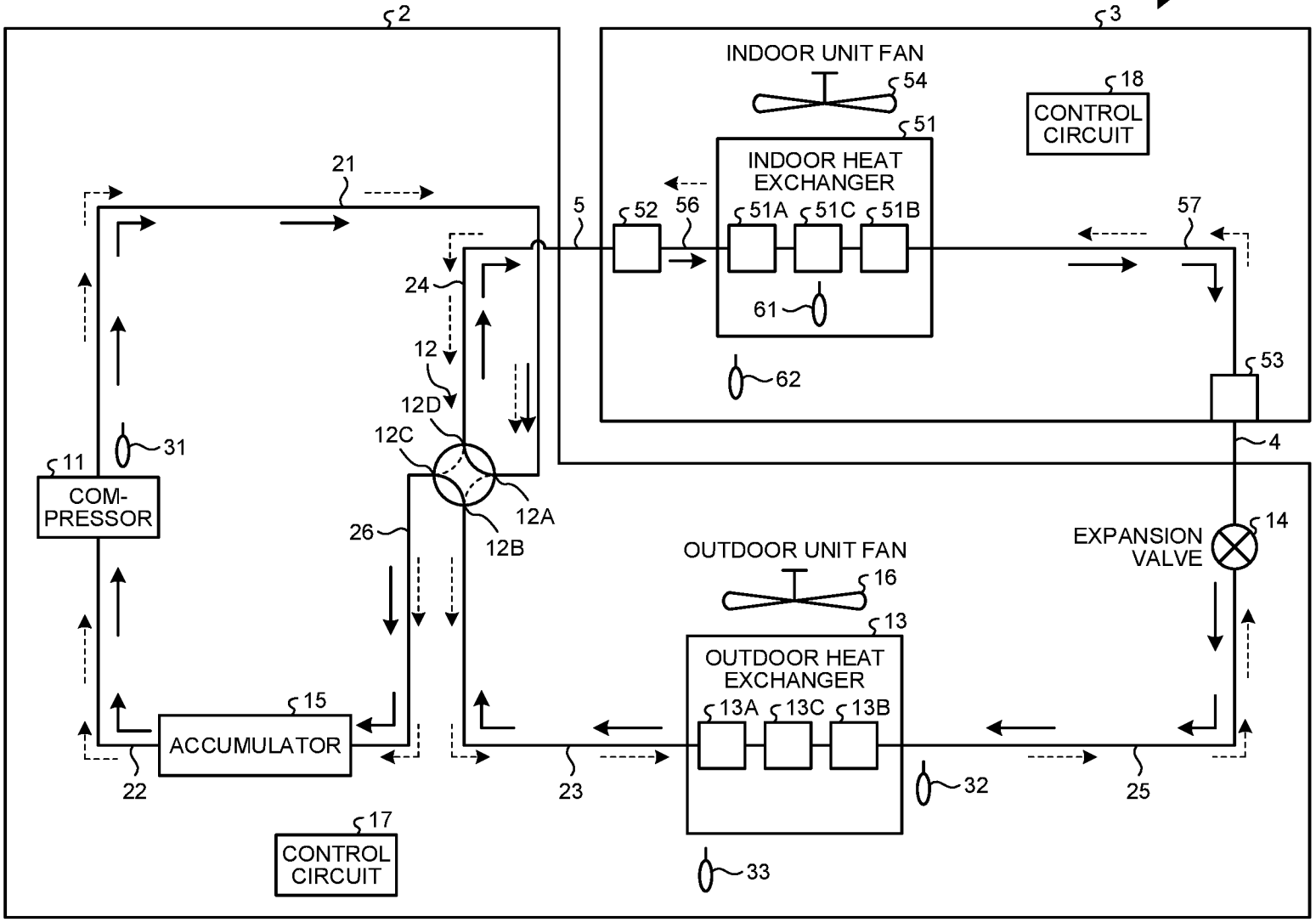
FIG. 2 is an explanatory diagram illustrating an example of an outdoor unit and an indoor unit.

FIG. 2 is an explanatory diagram illustrating an example of the outdoor unit 2 and the indoor unit 3. The outdoor unit 2 has a compressor 11, a four-way valve 12, an outdoor heat exchanger 13, an expansion valve 14, an accumulator 15, an outdoor unit fan 16, and a control circuit 17. An outdoor refrigerant circuit forming part of the refrigerant circuit 6 is formed using these compressor 11, four-way valve 12, outdoor heat exchanger 13, expansion valve 14, and accumulator 15 connected to each other by refrigerant piping described in detail hereinafter.

The compressor 11 is, for example, a high pressure container type variable capacity compressor having operation capacity that is variable according to the drive of a motor having rotation frequency controlled by an inverter, the motor not being illustrated in the drawings. A refrigerant discharge end of the compressor 11 is connected to a first port 12A of the four-way valve 12 by a discharge pipe 21. Furthermore, a refrigerant intake end of the compressor 11 is connected to a refrigerant outflow end of the accumulator 15 by an intake pipe 22.

The four-way valve 12 is a valve for switching the direction in which a refrigerant flows in the refrigerant circuit 6, and includes the first port 12A to a fourth port 12D. The first port 12A is connected to the refrigerant discharge end of the compressor 11 by the discharge pipe 21. The second port 12B is connected to one of refrigerant ports (a first outdoor heat exchanger port portion 13A described later) of the outdoor heat exchanger 13 by an outdoor refrigerant pipe 23. The third port 12C is connected to a refrigerant inflow end of the accumulator 15 by an outdoor refrigerant pipe 26. The fourth port 12D is connected to an indoor heat exchanger 51 by an outdoor gas pipe 24.

The outdoor heat exchanger 13 causes heat exchange between: the refrigerant; and outside air taken into the outdoor unit 2 by rotation of the outdoor unit fan 16. The outdoor heat exchanger 13 has the first outdoor heat exchanger port portion 13A that is the one of the refrigerant ports mentioned above, a second outdoor heat exchanger port portion 13B that is the other one of the refrigerant ports, and an outdoor heat exchanger intermediate portion 13C that connects the first outdoor heat exchanger port portion 13A and the second outdoor heat exchanger port portion 13B to each other. The first outdoor heat exchanger port portion 13A is connected to the second port 12B of the four-way valve 12 by the outdoor refrigerant pipe 23. The second outdoor heat exchanger port portion 13B is connected to the expansion valve 14 by an outdoor liquid pipe 25. The outdoor heat exchanger intermediate portion 13C is connected to the first outdoor heat exchanger port portion 13A and the second outdoor heat exchanger port portion 13B. The outdoor heat exchanger 13 functions as a condenser in a case where the air conditioner 1 performs cooling operation and functions as an evaporator in a case where the air conditioner 1 performs heating operation.

The expansion valve 14 is an electronic expansion valve provided at the outdoor liquid pipe 25 and driven by a pulse motor not illustrated in the drawings. The expansion valve 14 adjusts the amount of refrigerant flowing into the refrigerant circuit 6 from the expansion valve 14 (the amount of refrigerant flowing into the indoor heat exchanger 51 from the outdoor heat exchanger 13 or the amount of refrigerant flowing into the outdoor heat exchanger 13 from the indoor heat exchanger 51) by adjustment of the degree of its opening according to a pulse number given to the pulse motor. In the case where the air conditioner 1 is performing heating operation, the degree of opening in the expansion valve 14 is adjusted so that discharge temperature of the refrigerant (refrigerant discharge temperature) at the compressor 11 reaches a target temperature that is a predetermined temperature.

The refrigerant inflow end of the accumulator 15 is connected to the third port 12C of the four-way valve 12 by the outdoor refrigerant pipe 26. Furthermore, the refrigerant outflow end of the accumulator 15 is connected to the refrigerant intake end of the compressor 11 by the intake pipe 22. The accumulator 15 separates the refrigerant that has flown into the accumulator 15 from the outdoor refrigerant pipe 26, into a gaseous refrigerant and a liquid refrigerant, and causes only the gaseous refrigerant to be suctioned into the compressor 11.

The outdoor unit fan 16 is formed of a resin material and arranged near the outdoor heat exchanger 13. According to rotation of a fan motor not illustrated in the drawings, the outdoor unit fan 16 takes outside air into the outdoor unit 2 from an intake port not illustrated in the drawings, and discharges the outside air that has been heat-exchanged with the refrigerant in the outdoor heat exchanger 13 to the outside of the outdoor unit 2 from a discharge port not illustrated in the drawings.

Furthermore, plural sensors are arranged in the outdoor unit 2. A discharge temperature sensor 31 that detects the temperature of the refrigerant discharged from the compressor 11, that is, the discharge temperature, is arranged at the discharge pipe 21. An outdoor heat exchanger outlet port sensor 32 for detecting, of heat exchanger temperatures, the temperature of the refrigerant flowing into the second outdoor heat exchanger port portion 13B or the temperature of the refrigerant flowing out from the second outdoor heat exchanger port portion 13B is arranged at the outdoor liquid pipe 25 between the outdoor heat exchanger 13 and the expansion valve 14. An outside air temperature sensor 33 that detects the temperature of the outside air flowing into the outdoor unit 2, that is, outside air temperature, is arranged near the intake port of the outdoor unit 2, the intake port not being illustrated in the drawings.

The control circuit 17 controls the outdoor unit 2 upon receipt of an instruction from a control circuit 18 of the indoor unit 3 described later. The control circuit 17 of the outdoor unit 2 has a communication unit, a storage unit, and a control unit, which are not illustrated in the drawings. The communication unit is a communication interface for communication with a communication unit of the indoor unit 3. The storage unit is, for example, a flash memory, and stores a control program for the outdoor unit 2, operation state quantities, such as detected values corresponding to detection signals from the various sensors, drive states of the compressor 11 and the outdoor unit fan 16, the rated capacity of the outdoor unit 2, and the required capacity of the indoor unit 3, for example.

Configuration of Indoor Unit

As illustrated in FIG. 2, the indoor unit 3 has an indoor heat exchanger 51, a gas pipe connection portion 52, a liquid pipe connection portion 53, an indoor unit fan 54, and the control circuit 18. These indoor heat exchanger 51, gas pipe connection portion 52, and liquid pipe connection portion 53 are connected to each other by refrigerant piping described later, and forms an indoor unit refrigerant circuit forming part of the refrigerant circuit 6.

The indoor heat exchanger 51 causes heat exchange between: the refrigerant; and indoor air taken into the indoor unit 3 from an intake port not illustrated in the drawings by rotation of the indoor unit fan 54. The indoor heat exchanger 51 has a first indoor heat exchanger port portion 51A that is one of its refrigerant ports, a second indoor heat exchanger port portion 51B that is the other one of the refrigerant ports, and an indoor heat exchanger intermediate portion 51C connecting the first indoor heat exchanger port portion 51A and the second indoor heat exchanger port portion 51B to each other. The first indoor heat exchanger port portion 51A is connected to the gas pipe connection portion 52 by an indoor gas pipe 56. The second indoor heat exchanger port portion 51B is connected to the liquid pipe connection portion 53 by an indoor liquid pipe 57. The indoor heat exchanger intermediate portion 51C is connected to the first indoor heat exchanger port portion 51A and the second indoor heat exchanger port portion 51B. The indoor heat exchanger 51 functions as a condenser in the case where the air conditioner 1 performs heating operation. By contrast, the indoor heat exchanger 51 functions as an evaporator in the case where the air conditioner 1 performs cooling operation.

The indoor unit fan 54 is formed of a resin material and arranged near the indoor heat exchanger 51. By being rotated by a fan motor not illustrated in the drawings, the indoor unit fan 54 takes indoor air into the indoor unit 3 from the intake port not illustrated in the drawings, and discharges the indoor air that has been heat-exchanged with the refrigerant in the indoor heat exchanger 51 to the inside of a room from a discharge port not illustrated in the drawings.

Various sensors are provided in the indoor unit 3. An indoor heat exchanger intermediate sensor 61 that detects, of heat exchanger temperatures, the temperature of the refrigerant passing through the indoor heat exchanger intermediate portion 51C, that is, indoor heat exchanger intermediate temperature, is arranged at the indoor heat exchanger intermediate portion 51C. An intake temperature sensor 62 that detects the temperature of the indoor air flowing into the indoor unit 3, that is, intake temperature, is arranged near the intake port of the indoor unit 3, the intake port not being illustrated in the drawings.

Figure 3:
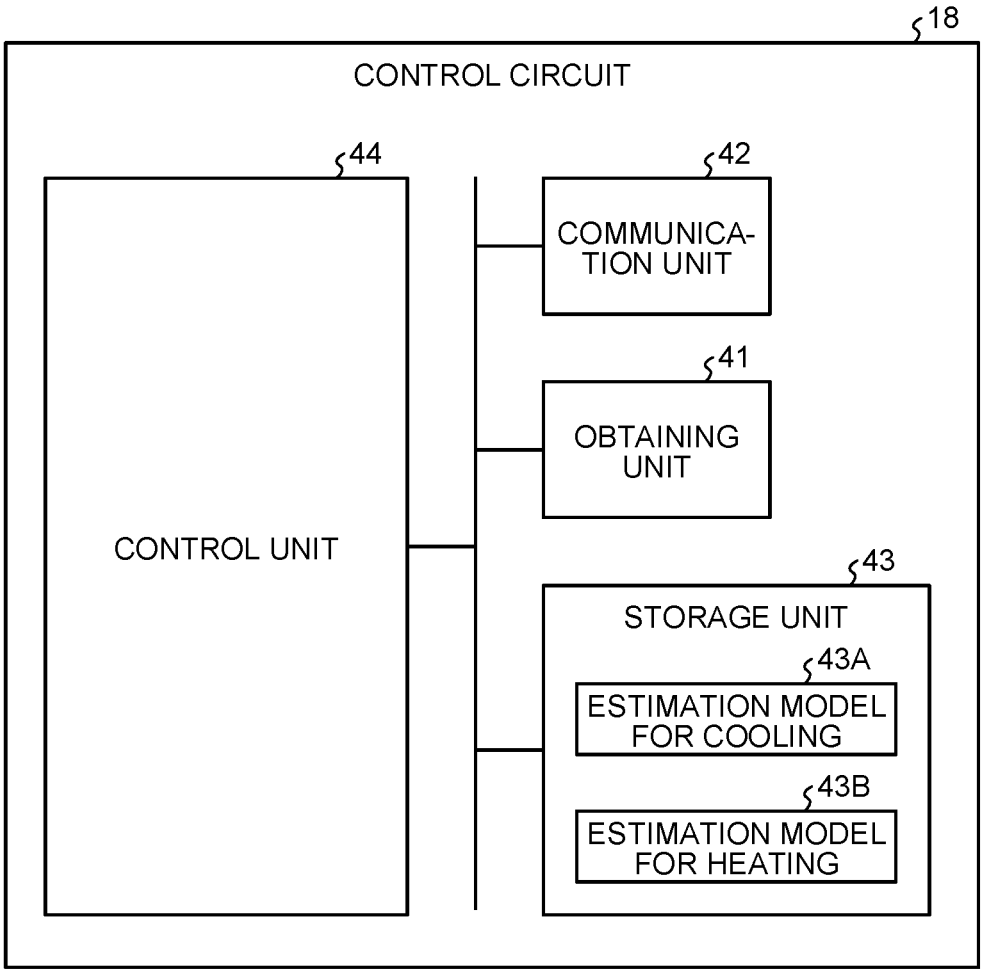
FIG. 3 is a block diagram illustrating an example of a control circuit of the outdoor indoor unit.

The control circuit 18 controls the overall air conditioner 1. FIG. 3 is a block diagram illustrating an example of the control circuit 18 of the indoor unit 3. The control circuit 18 has an obtaining unit 41, a storage unit 43, and a control unit 44. The obtaining unit 41 obtains sensor values from the various sensors mentioned above. A communication unit 42 is a communication interface for communication with the communication unit in the outdoor unit 2. The storage unit 43 is, for example a flash memory, and stores a control program for the indoor unit 3, operation state quantities, such as detected values corresponding to detection signals from the various sensors, a drive state of the indoor unit fan 54, operation information transmitted from the outdoor unit 2 (including, for example, operation and non-operation information on the compressor 11 and a drive state of the outdoor unit fan 16), the rated capacity of the outdoor unit 2, and the required capacity of the indoor unit 3, for example.

Furthermore, the storage unit 43 stores an estimation model for estimation of the amount of refrigerant remaining in the refrigerant circuit 6. In this embodiment, for example, a relative amount of refrigerant is used as the amount of refrigerant remaining in the refrigerant circuit 6. Specifically, the storage unit 43 of this embodiment stores an estimation model for estimation of a refrigerant shortage rate (hereinafter, referring to a decrease from 100% where the refrigerant circuit 6 is filled with a defined amount of the refrigerant) in the refrigerant circuit 6. The estimation model has an estimation model for cooling 43A and an estimation model for heating 43B.

The control unit 44 periodically (for example, every 30 seconds) takes in detected values from the various sensors. On the basis of these various types of information input, the control unit 44 controls the overall air conditioner 1. Furthermore, the control unit 44 estimates a refrigerant shortage rate using each estimation model mentioned above.

Operation of Refrigerant Circuit

Flows of the refrigerant in the refrigerant circuit 6 and operation of each unit in air conditioning operation of the air conditioner 1 of this embodiment will be described next.

In the case where the air conditioner 1 performs heating operation, the four-way valve 12 is switched so that the first port 12A and the fourth port 12D are in communication with each other and the second port 12B and the third port 12C are in communication with each other (a state indicated by solid lines in FIG. 2). The refrigerant circuit 6 is thereby brought into a heating cycle where the indoor heat exchanger 51 functions as a condenser and the outdoor heat exchanger 13 functions as an evaporator. For convenience of explanation, the flow of the refrigerant in the heating operation will be indicated by solid arrows illustrated in FIG. 2.

In response to the compressor 11 being driven, with the refrigerant circuit 6 being in this state, the refrigerant discharged from the compressor 11 flows through the discharge pipe 21 into the four-way valve 12, flows to the outdoor gas pipe 24 from the four-way valve 12, and flows into the gas pipe 5. The refrigerant flowing through the gas pipe 5 flows into the indoor unit 3 via the gas pipe connection portion 52. The refrigerant that has flown into the indoor unit 3 flows through the indoor gas pipe 56 into the indoor heat exchanger 51. The refrigerant that has flown into the indoor heat exchanger 51 is condensed by being heat-exchanged with the indoor air that has been taken into the indoor unit 3 through the rotation of the indoor unit fan 54. That is, the indoor heat exchanger 51 functions as a condenser, the indoor air that has been heated through the heat exchange with the refrigerant in the indoor heat exchanger 51 is discharged from the discharge port not illustrated in the drawings, to the inside of the room, and the room where the indoor unit 3 has been placed is thereby heated.

The refrigerant that has flown into the indoor liquid pipe 57 from the indoor heat exchanger 51 flows out to the liquid pipe 4 via the liquid pipe connection portion 53. The refrigerant that has flown into the liquid pipe 4 flows into the outdoor unit 2. The refrigerant that has flown into the outdoor unit 2 flows through the outdoor liquid pipe 25, and is decompressed through the expansion valve 14. The refrigerant that has been decompressed at the expansion valve 14 flows through the outdoor liquid pipe 25 into the outdoor heat exchanger 13, and is evaporated by being heat-exchanged with the outside air that has flown in from the intake port of the outdoor unit 2 through the rotation of the outdoor unit fan 16, the intake port not being illustrated in the drawings. The refrigerant that has flown out from the outdoor heat exchanger 13 to the outdoor refrigerant pipe 26 flows into the four-way valve 12, the outdoor refrigerant pipe 26, the accumulator 15, and the intake pipe 22 in this order, is suctioned into the compressor 11 to be compressed again, and flows out to the outdoor gas pipe 24 via the first port 12A and fourth port 12D of the four-way valve 12.

Furthermore, in the case where the air conditioner 1 performs cooling operation, the four-way valve 12 is switched so that the first port 12A and the second port 12B are in communication with each other and the third port 12C and the fourth port 12D are in communication with each other. The refrigerant circuit 6 is thereby brought into a cooling cycle where the indoor heat exchanger 51 functions as an evaporator and the outdoor heat exchanger 13 functions as a condenser. For convenience of explanation, the flow of the refrigerant in the cooling operation will be indicated by dashed arrows illustrated in FIG. 2.

In response to the compressor 11 being driven, with the refrigerant circuit 6 being in this state, the refrigerant discharged from the compressor 11 flows through the discharge pipe 21 into the four-way valve 12, flows to the outdoor refrigerant pipe 23 from the four-way valve 12, and flows into the outdoor heat exchanger 13. The refrigerant that has flown into the outdoor heat exchanger 13 is condensed by being heat-exchanged with the outside air that has been taken into the outdoor unit 2 through the rotation of the outdoor unit fan 16. That is, the outdoor heat exchanger 13 functions as a condenser and the indoor air that has been heated by the refrigerant in the outdoor heat exchanger 13 is discharged to the outside of the room from the discharge port not illustrated in the drawings.

The refrigerant that has flown into the outdoor liquid pipe 25 from the outdoor heat exchanger 13 is decompressed through the expansion valve 14. The refrigerant that has been decompressed at the expansion valve 14 flows through the liquid pipe 4 into the indoor unit 3. The refrigerant that has flown into the indoor unit 3 flows through the indoor liquid pipe 57 into the indoor heat exchanger 51, and is evaporated by being heat-exchange with the indoor air that has flown in from the intake port of the indoor unit 3 through the rotation of the indoor unit fan 54, the intake port not being illustrated in the drawings. That is, the indoor heat exchanger 51 functions as an evaporator, the indoor air that has been cooled by being heat-exchanged with the refrigerant in the indoor heat exchanger 51 is discharged from the discharge port not illustrated in the drawings, to the inside of the room, and the room where the indoor unit 3 has been placed is thereby cooled.

The refrigerant that flows into the gas pipe 5 via the gas pipe connection portion 52 from the indoor heat exchanger 51 flows to the outdoor gas pipe 24 in the outdoor unit 2 and flows into the fourth port 12D of the four-way valve 12. The refrigerant that has flown into the fourth port 12D of the four-way valve 12 flows to the refrigerant inflow end of the accumulator 15 from the third port 12C. The refrigerant that has flown in from the refrigerant inflow end of the accumulator 15 is suctioned into the compressor 11 via the intake pipe 22 and compressed therein again.

The obtaining unit 41 in the control circuit 18 obtains sensor values from the discharge temperature sensor 31, the outdoor heat exchanger outlet port sensor 32, and the outside air temperature sensor 33, via the control circuit 17 of the outdoor unit 2. Furthermore, the obtaining unit 41 obtains sensor values from the indoor heat exchanger intermediate sensor 61 and intake temperature sensor 62 that are in the indoor unit 3.

Figure 4:
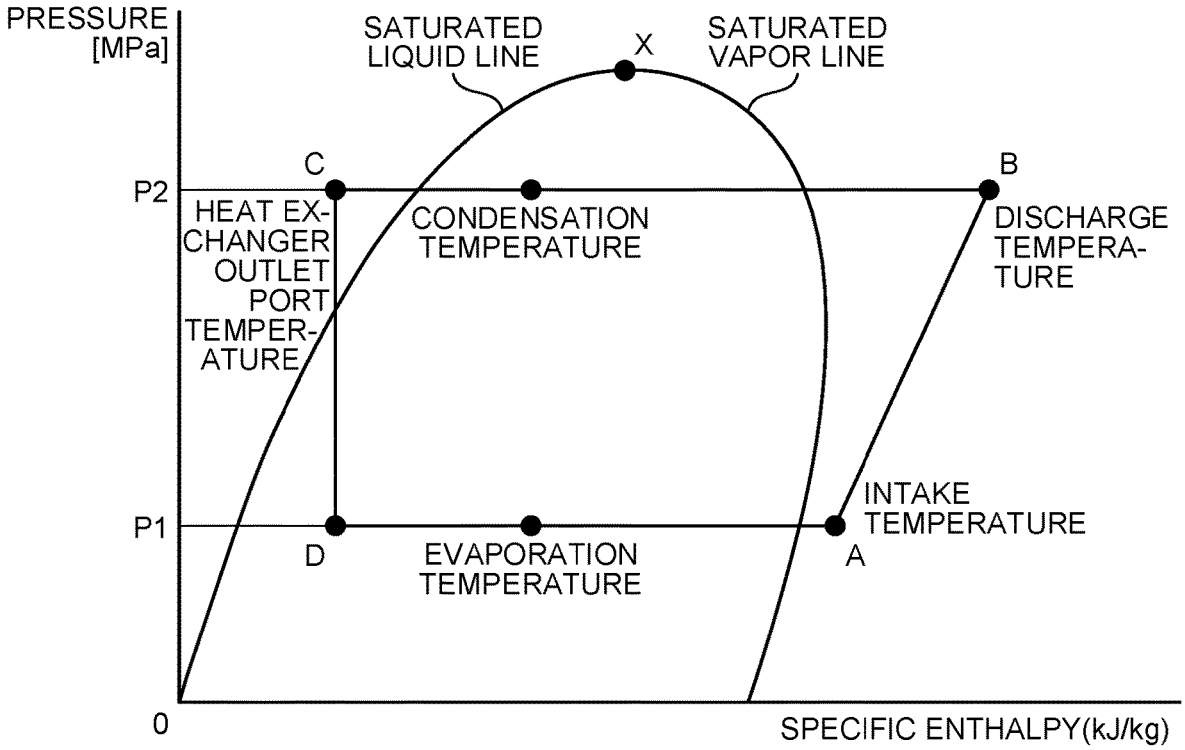
FIG. 4 is a Mollier diagram illustrating states of changes in a refrigerant of the air conditioner.

FIG. 4 is a Mollier diagram illustrating a refrigeration cycle of the air conditioner 1. During the cooling operation of the air conditioner 1, the outdoor heat exchanger 13 functions as a condenser and the indoor heat exchanger 51 functions as an evaporator. Furthermore, during the heating operation of the air conditioner 1, the outdoor heat exchanger 13 functions as an evaporator and the indoor heat exchanger 51 functions as a condenser.

The compressor 11 discharges the refrigerant that is gaseous and high in temperature and pressure (the refrigerant in a state at a point B in FIG. 4), by compressing the refrigerant that is gaseous and low in temperature and pressure and that flows into the compressor 11 from the evaporator (the refrigerant in a state at a point A in FIG. 4). The temperature of the gaseous refrigerant discharged from the compressor 11 is the discharge temperature and the discharge temperature is detected by the discharge temperature sensor 31.

The condenser condenses the gaseous refrigerant high in temperature and pressure from the compressor 11 by causing heat exchange between the gaseous refrigerant and the air. After the gaseous refrigerant has become all liquid in the condenser due to a change in latent heat, the liquid refrigerant is decreased in temperature due to a change in sensible heat and brought into a supercooled state (a state at a point C in FIG. 4). The temperature of the refrigerant during the change from the gaseous refrigerant to the liquid refrigerant due to the change in latent heat is condensation temperature and the temperature of the refrigerant in a supercooled state at an outlet port of the condenser is heat exchanger outlet port temperature. Of the heat exchanger temperatures, the heat exchanger outlet port temperature is detected by the outdoor heat exchanger outlet port sensor 32 in the cooling operation. The flow of the refrigerant in the heating operation is opposite to that in the cooling operation and the outdoor heat exchanger 13 functions as an evaporator. During the heating operation, the outdoor heat exchanger outlet port sensor 32 is used to detect the temperature of the outdoor heat exchanger 13 to detect any freezing and to control defrosting operation.

The expansion valve 14 decompresses the refrigerant that has flown out from the condenser and that is low in temperature and high in pressure. The refrigerant that has been decompressed at the expansion valve 14 is a gas-liquid two-phase refrigerant having a mixture of gas and liquid (the refrigerant in a state at a point D in FIG. 4).

The evaporator evaporates the gas-liquid two-phase refrigerant that has flown into the evaporator by causing heat exchange between the gas-liquid two-phase refrigerant and the air. After the gas-liquid two-phase refrigerant has become all gaseous in the evaporator due to a change in latent heat, the gaseous refrigerant is increased in temperature due to a change in sensible heat, brought into a superheated state (a state at the point A in FIG. 4), and suctioned into the compressor 11. The temperature of the refrigerant during the change from the liquid refrigerant to the gaseous refrigerant due to the change in latent heat is evaporation temperature. The evaporation temperature is the indoor heat exchanger intermediate temperature detected by the indoor heat exchanger intermediate sensor 61 in the cooling operation. Furthermore, the temperature of the refrigerant superheated in the evaporator and suctioned into the compressor 11 is the intake temperature. The flow of the refrigerant in the heating operation is opposite to that in the cooling operation and the indoor heat exchanger 51 functions as a condenser. In the heating operation, detection results from the indoor heat exchanger intermediate sensor 61 are used in calculation of a target discharge temperature.

Configuration of Estimation Model

The estimation model is generated by multi-regression analysis that is one type of regression analysis, by using a discretionary operation state quantity (feature quantity) of plural operation state quantities. In the multi-regression analysis, a regression equation is selected to be generated as the estimation model, the regression equation being an equation in which a P value (a value indicating the degree of influence exerted by an operation state quantity on accuracy of the estimation model generated (a predetermined weight parameter)) becomes the smallest and a correction value R2 (a value indicating the accuracy of the estimation model generated) becomes a value equal to or larger than 0.9 and equal to or less than 1.0 and as large as possible, the regression equation being one of regression equations obtained from test results using an actual air conditioner (hereinafter, a real machine) (results of testing what values the operation state quantity takes in a case where the amount of refrigerant remaining in the refrigerant circuit is changed using the real machine) or plural simulation results (results of reproducing a refrigerant circuit by numerical computation and calculating what values the operation state quantity takes in relation to the remaining amounts of refrigerant). In generating the estimation model by the multi-regression analysis, the P value and the correction value R2 are values related to the accuracy of the estimation model, and the smaller the P value or the closer the correction value R2 to 1.0, the higher the accuracy of the estimation model generated.

The estimation model is a remaining refrigerant amount estimation model for estimation of the amount of remaining refrigerant remaining in the refrigerant circuit 6. For example, the remaining refrigerant amount estimation model has the estimation model for cooling 43A and the estimation model for heating 43B. In this embodiment, these estimation models are generated using test results using a real machine as described later and stored in the control circuit 18 of the air conditioner 1 beforehand.

The estimation model for cooling 43A is a first regression equation enabling accurate estimation of a refrigerant shortage rate in the cooling operation.

$$\text{First regression equation}=(\alpha 1\times\text{rotation frequency of compressor})+(\alpha 2\times\text{degree of opening of expansion valve}+(\alpha 3\times\text{discharge temperature at compressor})+(\alpha 4\times\text{heat exchanger outlet port temperature})+(\alpha 5\times\text{outside air temperature})+\alpha 6 \quad (1)$$

Coefficients $\alpha 1$ to $\alpha 6$ are determined upon generation of the estimation model. The control unit 44 calculates a refrigerant shortage rate in the refrigerant circuit 6 at the present point in time by substituting, into the first regression equation, the present rotation frequency of the compressor 11, the present degree of opening of the expansion valve 14, the present discharge temperature at the compressor 11, the present outdoor heat exchanger outlet port temperature, and the present outside temperature that are obtained by the obtaining unit 41. The rotation frequency of the compressor 11, the degree of opening of the expansion valve, the discharge temperature at the compressor 11, the outdoor heat exchanger outlet port temperature, and the outside temperature are substituted therein to use the feature quantities used in the generation of the estimation model for cooling 43A. The rotation frequency of the compressor 11 is detected by, for example, a rotation frequency sensor of the compressor 11, the rotation frequency sensor not being illustrated in the drawings. The degree of opening of the expansion valve is adjusted by a pulse signal input to a stepping motor (not illustrated in the drawings) of the expansion valve from the control unit 44, for example. The discharge temperature at the compressor 11 is detected by the discharge temperature sensor 31. Of the heat exchanger temperatures, the heat exchanger outlet port temperature is detected by the outdoor heat exchanger outlet port sensor 32. The outside air temperature is detected by the outside air temperature sensor 33.

The estimation model for heating 43B is a second regression equation enabling accurate estimation of a refrigerant shortage rate in the heating operation.

$$\text{Second regression equation}=(\alpha 11\times\text{rotation frequency of compressor})+(\alpha 12\times\text{degree of opening of expansion valve})+(\alpha 13\times\text{discharge temperature at compressor})+(\alpha 14\times\text{indoor heat exchanger intermediate temperature})+\alpha 5 \quad (2)$$

Coefficients $\alpha 11$ to $\alpha 15$ are determined upon generation of the estimation model. The control unit 44 calculates a refrigerant shortage rate in the refrigerant circuit 6 at the present point in time by substituting, into the second regression equation, the present rotation frequency of the compressor 11, the present degree of opening of the expansion valve 14, the present discharge temperature at the compressor 11, and the present indoor heat exchanger intermediate temperature that are obtained by the obtaining unit 41. The rotation frequency of the compressor 11, the degree of opening of the expansion valve 14, the discharge temperature at the compressor 11, and the indoor heat exchanger intermediate temperature are substituted therein to use the feature quantities used in the generation of the estimation model for heating 43B. The rotation frequency of the compressor 11 is detected by, for example, the rotation frequency sensor of the compressor 11, the rotation frequency sensor not being illustrated in the drawings. The degree of opening of the expansion valve is adjusted by a pulse signal input to the stepping motor (not illustrated in the drawings) of the expansion valve from the control unit 44, for example. The discharge temperature at the compressor 11 is detected by the discharge temperature sensor 31. Of the heat exchanger temperatures, the indoor heat exchanger intermediate temperature is detected by the indoor heat exchanger intermediate sensor 61.

As described hereinbefore, a refrigerant shortage rate in the cooling operation is estimated using the first regression equation. Furthermore, a refrigerant shortage rate in the heating operation is estimated using the second regression equation.

Operation in Estimation Processing

Figure 5:
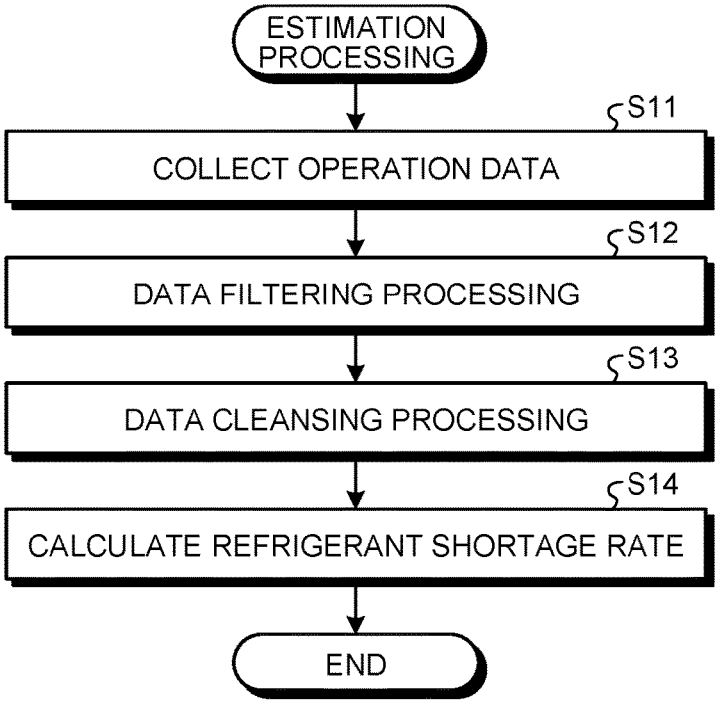
FIG. 5 is a flowchart illustrating an example of operation in processing by the control circuit, the processing being related to estimation processing.

FIG. 5 is a flowchart illustrating an example of operation in processing by the control circuit 18, the processing being related to estimation processing. In this embodiment, the control circuit 18 holds the estimation model for cooling 43A and the estimation model for heating 43B that have been generated beforehand. In FIG. 5, the control unit 44 in the control circuit 18 collects, as operation data, operation state quantities, through the obtaining unit 41 (Step S11). The control unit 44 executes data filtering processing of extracting a discretionary operation state quantity from the operation data collected (Step S12). Furthermore, the control unit 44 executes data cleansing processing excluding any abnormal value and outstanding value (Step S13). The control unit 44 calculates a refrigerant shortage rate in the refrigerant circuit 6 at the present point in time by using the relevant regression equation (Step S14) and ends the operation in the processing illustrated in FIG. 5.

Without using all of the plural operation state quantities, through the data filtering processing, some of operation state quantities needed for calculation of a refrigerant shortage rate, of the plural operation state quantities, are extracted on the basis of a predetermined filtering condition. Substituting the operation state quantities that have been subjected to the data cleansing processing (excluding any abnormal value and outstanding value) into the regression equation of the estimation model generated enables more accurate estimation of the refrigerant shortage rate.

The predetermined filtering condition has a first filtering condition, a second filtering condition, and a third filtering condition. The first filtering condition is, for example, a filtering condition for data extracted commonly to all operation modes of the air conditioner 1. The second filtering condition is a filtering condition for data extracted in the cooling operation. The third filtering condition is a filtering condition for data extracted in the heating operation.

The first filtering condition is, for example, a drive state of the compressor 11, identification of an operation mode, exclusion of special operation, exclusion of any missing value in obtained values, and selection of a value small in change for an operation state quantity that exerts a large influence in generation of the regression equation. The drive state of the compressor 11 is a filtering condition that: is a condition needed for determination because a refrigerant shortage rate is unable to be estimated unless the compressor is operating stably and the refrigerant is thus circulating through the refrigerant circuit 6; excludes operation state quantities detected in a transition period, such as a start-up period of the compressor 11; and extracts only operation state quantities obtained when the discharge temperature has reached a target temperature that is a predetermined temperature, for example. According to this filtering condition, operation state quantities obtained at the time when the absolute value of the difference between the discharge temperature and the target temperature is larger than a predetermined value are excluded, and operation state quantities obtained at the time when the absolute value of the difference between the discharge temperature and the target temperature is at the predetermined value or less are extracted. The predetermined value is the absolute value of the difference between the target discharge temperature and the detected discharge temperature, the absolute value being, for example, 2° C. or less.

The identification of an operation mode is a filtering condition for extracting only operation state quantities obtained during the cooling operation and the heating operation. Therefore, operation state quantities obtained during dehumidification operation and ventilation operation are excluded. Exclusion of special operation is a filtering condition for exclusion of operation state quantities obtained during special operation, such as, for example, oil recovery operation or defrosting operation, the special operation being where the state of the refrigerant circuit 6 is largely different from that during the cooling operation or the heating operation. The exclusion of any missing value (a value that was unable to be obtained) is a filtering condition for exclusion of an operation state quantity including a missing value because if there is any missing value in an operation state quantity used in determination of a refrigerant shortage rate, the accuracy of the regression equation generated using the operation state quantity may be degraded.

The selection of any value small in change for an operation state quantity substituted into the regression equation is a filtering condition for extraction of only operation state quantities obtained in a state where the operation state of the air conditioner 1 is stable and is a condition needed to increase the estimation accuracy of the regression equation.

The second filtering condition includes, for example, exclusion of the heat exchanger outlet port temperature and abnormality of the discharge temperature.

The exclusion of the heat exchanger outlet port temperature is a filtering condition in consideration of the fact that, during the cooling operation, the heat exchanger outlet port temperature detected by the outdoor heat exchanger outlet port sensor 32 does not become lower than the outside air temperature detected by the outside air temperature sensor 33 due to the placement of the outside air temperature sensor 33 and the outdoor heat exchanger outlet port sensor 32 close to each other, and is thus a filtering condition for exclusion of any heat exchanger outlet port temperature lower than the outside air temperature.

The abnormality of the discharge temperature is a filtering condition for exclusion of any discharge temperature detected at a suctioned refrigerant reduction state where the amount of refrigerant suctioned into the compressor 11 is reduced due to a small cooling load.

The third filtering condition is, for example, abnormality of the discharge temperature. This is a filtering condition for exclusion of any discharge temperature detected when the discharge temperature is reduced by reduction in the rotation frequency of the compressor 11, for example, in response to execution of discharge temperature protection control upon increase in discharge temperature due to a large heating load during the heating operation.

The data cleansing processing is processing for excluding any operation state quantity that may lead to wrong estimation, without using all of the obtained operation state quantities in estimation of a refrigerant shortage rate. Specifically, noise reduction by smoothing of the obtained operation state quantities or limitation of the number of data may be performed. The noise reduction by smoothing of data is processing of reducing noise by calculating the mean value for a relevant interval and finding the moving average of intake temperatures in each model, for example. Limitation of the number of data is processing of excluding, for example, the one having a small number of data because that would be less reliable. For example, if the number of data remaining after filtering processing of input data corresponding to one day is X or more, the data are used for estimation of a refrigerant shortage rate and if the number is less than X, none of the data for that day are used. That is, in the data cleansing processing, substituting operation state quantities excluding any abnormal value and outstanding value into the regression equation of an estimation model enables more accurate estimation of a refrigerant shortage rate.

The control circuit 18 calculates a refrigerant shortage rate of the refrigerant circuit 6 at the present point in time by, for example, substituting the present operation state quantities (sensor values) that have been subjected to the data filtering processing and data cleansing processing into the regression equation or refrigerant shortage rate calculation formula, of an estimation model. The control unit 44 in the control circuit 18 determines whether or not the cooling operation is being performed presently. In a case where the cooling operation is being performed presently, the control unit 44 substitutes the present operation state quantities into the estimation model for cooling 43A to calculate a refrigerant shortage rate at the present point in time.

In a case where the cooling operation is not being performed presently, the control unit 44 substitutes the present operation state quantities into the estimation model for heating 43B to calculate a refrigerant shortage rate at the present point in time.

Method of Generating Regression Equation

Feature quantities used in generation of the first regression equation and the second regression equation will be described next. In the cooling operation for which the first regression equation is used, operation state quantities, such as, for example, the rotation frequency of the compressor 11, the degree of opening of the expansion valve 14, the discharge temperature at the compressor 11, the outdoor heat exchanger outlet port temperature, and the outside air temperature, are used as the feature quantities used in generation of the first regression equation by multi-regression analysis. For these operation state quantities, results of tests using a real machine are used. Furthermore, in the heating operation for which the second regression equation is used, operation state quantities, such as, for example, the rotation frequency of the compressor 11, the degree of opening of the expansion valve 14, the discharge temperature at the compressor 11, and the indoor heat exchanger intermediate temperature, are used as the feature quantities for multi-regression analysis. For these operation state quantities, results of tests using a real machine are used.

Specifically, tests using a real machine are performed at different indoor temperatures and refrigerant filling amounts when the indoor unit 3 is operating, for example, in the design stage of the air conditioner 1, and relations between the feature quantities and the refrigerant shortage rate are obtained. As conditions for these tests using the real machine, for example, different outside air temperatures are used, for example, 20° C., 25° C., 30° C., 35° C., and 40° C. In performing the tests using the real machine, any parameter other than the outside air temperature may be added.

A discretionary operation state quantity (feature quantity) to be used for an estimation model, of the plural operation state quantities, is obtained from the test results (hereinafter, training data) indicating the relations between the plural operation state quantities and the refrigerant filling amount. The training data may be: training data associating between the amount of refrigerant remaining and each operation state quantity (training data used in generation of an estimation model by multi-regression analysis); or training data associating between states and each operation state quantity (training data used in generation of an estimation model for classification as normal or abnormal), the states including a state where the amount of refrigerant remaining is not too deficient (for example, a state where the cooling capacity or heating capacity demanded by a user is able to be maintained (a normal state) even if the amount of refrigerant remaining has decreased from the initial refrigerant filling amount) and a state where the amount of refrigerant remaining is deficient (a state where the cooling capacity or heating capacity demanded by the user is not able to be maintained (an abnormal state)).

In the multi-regression analysis, tests using a real machine are performed at different refrigerant filling amounts, for example, operation state quantities for different outside air temperatures are obtained, and the operation state quantities are classified into different sets of data for the respective refrigerant filling amounts. FIG. 6 is an explanatory diagram illustrating an example of the training data used in the multi-regression analysis. Operation state quantities used as the training data may be, for example, operation state quantities of the compressor 11, the indoor unit 3, and the outdoor unit 2. The operation state quantities of the compressor 11 may be, for example, the rotation frequency, the target rotation frequency, the operation time period, the discharge temperature, the target discharge temperature, and the output voltage. Furthermore, the operation state quantities of the indoor unit 3 may be, for example, the fan rotation frequency, the fan target rotation frequency, and the heat exchanger intermediate sensor temperature. In addition, the operation state quantities of the outdoor unit 2 may be, for example, the fan rotation frequency, the fan target rotation frequency, the degree of opening of the expansion valve, the target degree of opening of the expansion valve, and the heat exchanger output port sensor temperature. As illustrated in FIG. 6, by machine learning with training data that are data for each refrigerant filling amount, a discretionary operation state quantity (feature quantity) for estimation of the amount of remaining refrigerant is extracted, a coefficient is derived, and an estimation is thereby generated.

FIG. 7 is an explanatory diagram illustrating an example of training data used in generation of an estimation model for classification of an amount of remaining refrigerant as normal or abnormal. By machine learning using training data, as illustrated in FIG. 7, a discretionary operation state quantity (feature quantity) for estimation of whether or not the amount of remaining refrigerant is normal is extracted, a coefficient is derived, and an estimation model is thereby generated.

Effects of First Embodiment

In the air conditioner 1 of the first embodiment, a refrigerant shortage rate is estimated using: an estimation model generated by multi-regression analysis using operation state quantities related to estimation of the refrigerant shortage rate of a refrigerant put in the refrigerant circuit 6; and the present operation state quantities obtained by a limited number of sensors (the rotation frequency of the compressor, the refrigerant discharge temperature at the compressor, the heat exchanger temperature (the indoor heat exchanger intermediate temperature, and the outdoor heat exchanger outlet port temperature), the degree of opening of the expansion valve, and/or the outside air temperature). The operation state quantities used in generating the estimation model are found by experimental operation of a real machine of the air conditioner 1 under various environments as described above, and estimation of a refrigerant shortage rate using this estimation model is thus enabled by use of operation state quantities obtained in a state where a user has caused the air conditioner 1 to operate normally (in the cooling operation or heating operation, for example). As a result, even for the air conditioner 1 that is for home use, a refrigerant shortage rate at the present moment in time is able to be estimated without adjustment of the refrigerant circuit 6 into a default state.

The estimation model installed in the air conditioner 1 is generated beforehand by regression analysis using an operation state quantity that largely influences the estimation of a refrigerant shortage rate of the refrigerant put in the refrigerant circuit 6, of plural operation state quantities. This estimation model is generated by selection of the operation state quantity that largely influences the estimation model, instead of use of all operation state quantities, and an accurate estimation model is thus able to be generated.

The estimation model for cooling installed in the air conditioner 1 is generated by regression analysis using operation state quantities that are largely influential in the cooling operation, the operation state quantities being the rotation frequency of the compressor 11, the degree of opening of the expansion valve, the discharge temperature at the compressor 11, the heat exchanger outlet port temperature, and the outside air temperature. As a result, an accurate estimation model for cooling is able to be generated for the cooling operation.

The estimation model for heating installed in the air conditioner 1 is generated by regression analysis using operation state quantities that are largely influential in the heating operation, the operation state quantities being the rotation frequency of the compressor 11, the degree of opening of the expansion valve 14, the discharge temperature at the compressor 11, and the indoor heat exchanger intermediate temperature. As a result, an accurate estimation model for heating is able to be generated for the heating operation.

The air conditioner 1 estimates a refrigerant shortage rate in the cooling operation by using the estimation model for cooling and the present operation state quantities in the cooling operation, and estimates a refrigerant shortage rate in the heating operation by using the estimation model for heating and the present operation state quantities in the heating operation. As a result, even the air conditioner 1 that is for home use is able to accurately estimate refrigerant shortage rates by using different estimation models for the respective operation states.

In multi-regression analysis processing, the present operation state quantities (sensor values) that have been subjected to data filtering processing and data cleansing processing are substituted into the regression equation of an estimation model. In this embodiment, feature quantities obtained by simulation are used in generation of the regression equation of an estimation model, and the feature quantities obtained by the simulation do not include any abnormal value or value that is outstandingly larger or smaller than the other values. Substituting operation state quantities into the regression equation of an estimation model generated using feature quantities not including any abnormal value or outstanding value enables more accurate estimation of a refrigerant shortage rate, the operation state quantities excluding any abnormal value or outstanding value through data filtering processing and data cleansing processing.

In the example described above with respect to this embodiment, operation state quantities are found by tests using a real machine in the design stage of the air conditioner 1, an estimation model is obtained by training a terminal, such as server having a learning function, using results of the tests, and the obtained estimation model is stored in the control circuit 18 beforehand. An estimation model obtained by training using simulation results may be stored beforehand, instead. Furthermore, a server 120 connected to the air conditioner 1 via a communication network 110 may be present, and this server 120 may generate the first regression equation and the second regression equation and transmit these equations to the air conditioner 1. Such an embodiment will be described hereinafter.

Second Embodiment

Configuration of Air Conditioning System

Figure 8:
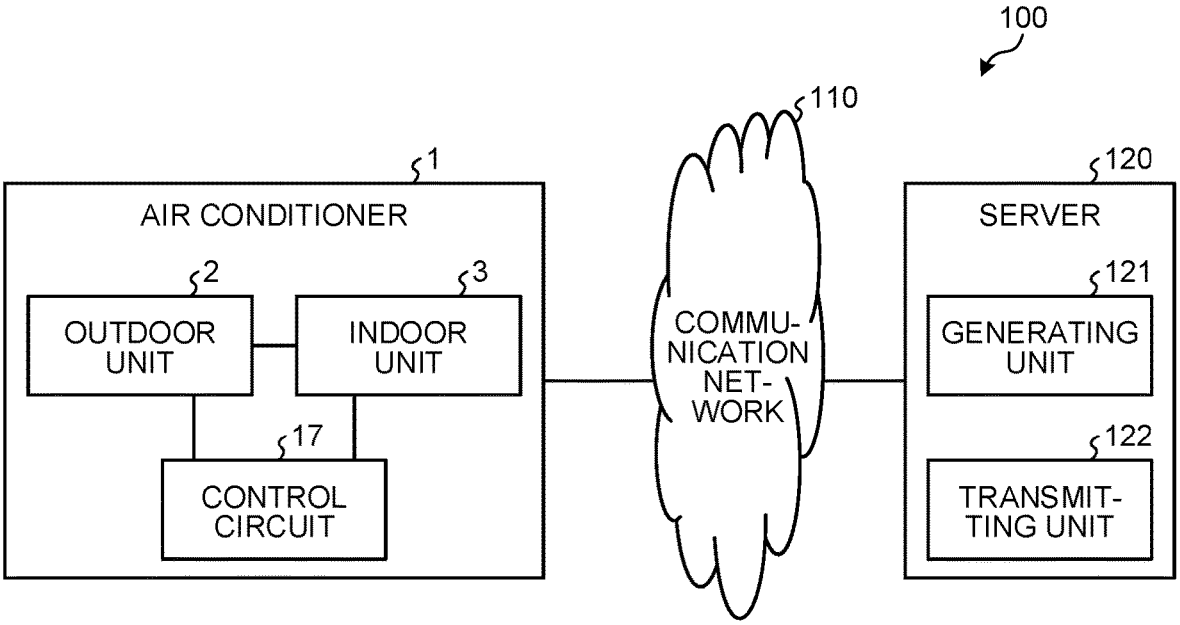
FIG. 8 is an explanatory diagram illustrating an example of an air conditioning system of a second embodiment.

FIG. 8 is an explanatory diagram illustrating an example of an air conditioning system 100 of a second embodiment. The same reference sign will be assigned to any component that is the same as that of the air conditioner 1 of the first embodiment and any redundant explanation of the component and operation thereof will be omitted. The air conditioning system 100 illustrated in FIG. 8 has an air conditioner 1, a communication network 110, and a server 120. The air conditioner 1 has: an outdoor unit 2 having a compressor 11, an outdoor heat exchanger 13, and an expansion valve 14; and an indoor unit 3 having an indoor heat exchanger 51. The air conditioner 1 includes a refrigerant circuit 6 formed by connection of the outdoor unit 2 and the indoor unit 3 to each other by refrigerant piping including a liquid pipe 4 and a gas pipe 5, and the refrigerant circuit 6 is filled with a predetermined amount of refrigerant.

The server 120 has a generating unit 121 and a transmitting unit 122. The generating unit 121 generates an estimation model by multi-regression analysis using operation state quantities related to estimation of a refrigerant shortage rate for a refrigerant put in the refrigerant circuit 6. The estimation model has, for example, the estimation model for cooling 43A and the estimation model for heating 43B described with respect to the first embodiment. The transmitting unit 122 transmits each estimation model generated by the generating unit 121, to the air conditioner 1 via the communication network 110. A control circuit 18 in the air conditioner 1 calculates a refrigerant shortage rate in the refrigerant circuit 6 of the air conditioner 1 by using each estimation model received.

The generating unit 121 in the server 120 periodically collects operation state quantities in cooling operation from a standard machine (placed in a testing room of the manufacturer, for example) of the air conditioner 1, the standard machine being capable of actually measuring a refrigerant shortage rate in the refrigerant circuit 6, and generates or updates the estimation model for cooling 43A by using: a result of comparison between a refrigerant shortage rate estimated using each estimation model and the actually measured refrigerant shortage rate; and the operation state quantities collected. The transmitting unit 122 in the server 120 periodically transmits the generated or updated estimation model for cooling 43A to the air conditioner 1. Operation state quantities to be used in generation of each estimation model may be obtained by simulation, and the generating unit 121 may generate each estimation model by using the operation state quantities obtained by the simulation, like in the first embodiment.

The generating unit 121 in the server 120 periodically corrects operation state quantities in heating operation from the above mentioned standard machine of the air conditioner 1, and generates the estimation model for heating 43B by using: a result of comparison between a refrigerant shortage rate estimated using an estimation model and the refrigerant shortage rate actually measured; and the operation state quantities collected. The transmitting unit 122 in the server 120 then periodically transmits the generated estimation model for heating 43B, to the air conditioner 1. Operation state quantities to be used in generation of each estimation model may be obtained by simulation, and the generating unit 121 may generate each estimation model by using the operation state quantities obtained by the simulation, like in the first embodiment.

Effects of Second Embodiment

The server 120 in this second embodiment generates an estimation model for estimation of a refrigerant shortage rate, by using multi-regression analysis using an operation state quantity related to estimation of a refrigerant shortage rate of a refrigerant put in the refrigerant circuit 6, and transmits the generated estimation model, to the air conditioner 1. The air conditioner 1 estimates a refrigerant shortage rate by using the estimation model received from the server 120 and the present operation state quantity. As a result, even the air conditioner 1 for home use is able to estimate the refrigerant shortage rate at the present point in time by using an accurate estimation model.

Furthermore, the case where a relative amount of refrigerant is estimated as the amount of refrigerant remaining in the refrigerant circuit 6 has been described with respect to this embodiment. Specifically, in the described case, a refrigerant shortage rate that is a proportion of the amount of refrigerant that has leaked outside from the refrigerant circuit 6 to the filling amount (initial value) at the time the refrigerant circuit 6 was filled with the refrigerant is estimated and provided. However, the present invention is not limited to this case, and the amount of refrigerant that has leaked outside from the refrigerant circuit 6 may be provided by multiplication of the estimated refrigerant shortage rate by the initial value. Furthermore, an estimation model for estimation of the absolute amount of refrigerant that has leaked outside from the refrigerant circuit 6 or the absolute amount of refrigerant remaining in the refrigerant circuit 6 may be generated, and a result of estimation by this estimation model may be provided. In a case where the estimation model for estimation of the absolute amount of refrigerant that has leaked outside the refrigerant circuit 6 or the absolute amount of refrigerant remaining in the refrigerant circuit 6 is generated, the volumes of the outdoor heat exchanger 13 and indoor heat exchanger 51 and the volume of the liquid pipe 4 may be considered in addition to the operation state quantities described thus far.

MODIFIED EXAMPLES

In the example described with respect to the embodiments, the control circuit 18 included in the indoor unit 3 controls the overall air conditioner 1, but the control circuit 18 may be included in the outdoor unit 2 or the cloud. In the example described with respect to the embodiments, estimation models may be generated by the server 120, but a person, instead of the server 120, may calculate an estimation model from simulation results.

Furthermore, in the example described with respect to the embodiments, the control circuit 18 in the indoor unit 3 estimates the amount of refrigerant using an estimation model, but the server 120 that generates an estimation model may estimate the amount of refrigerant. In addition, in the example described above with respect to the embodiments, each estimation model is generated using multi-regression analysis, but an estimation model may be generated using a machine learning technique, such as support vector regression (SVR) or a neural network (NN), that enables general regression analysis. In this case, a general technique (such as forward feature selection or backward feature elimination) may be used in selection of feature quantities, the general technique being for selection of feature quantities to improve accuracy of the estimation model, instead of the P value and the correction value R2 used in the multi-regression analysis.

Furthermore, each component of each unit illustrated in the drawings is not necessarily configured physically as illustrated in the drawings. That is, specific modes of separation and integration of each unit are not limited to those illustrated in the drawings, and all or part of each unit may be configured to be separated or integrated functionally or physically in any units, according to various loads and/or use situations, for example.

Furthermore, all or any part of various processing functions implemented in each device may be executed on a central processing unit (CPU) (or a microcomputer, such as a microprocessing unit (MPU)) or microcontroller unit (MCU)). In addition, all or any part of the various processing functions may be executed on a program analyzed and executed by a CPU (or a microcomputer, such as an MPU or MCU) or on hardware by wired logic, needless to say.

Furthermore, in each of the embodiments described above, a refrigerant shortage rate is a decrease from 100% where a defined amount of refrigerant is put therein. Instead, a refrigerant shortage rate may be estimated by the method described with respect to the embodiments immediately after the refrigerant circuit 6 is filled with a prescribed amount of refrigerant and a result of this estimation may be regarded as 100%. For example, in a case where the refrigerant shortage rate estimated immediately after the refrigerant circuit 6 is filled with a prescribed amount of refrigerant is 90%, that is, in a case where the amount of refrigerant put in the refrigerant circuit 6 is estimated to be 10% less than the fill-up with the prescribed amount, the amount of refrigerant 10% less than the fill-up with the prescribed amount may be regarded as 100%. Adjusting the amount of refrigerant of 100% to the estimation result enables more accurate estimation of a refrigerant shortage rate thereafter.

REFERENCE SIGNS LIST

1 AIR CONDITIONER
2 OUTDOOR UNIT
3 INDOOR UNIT
4 LIQUID PIPE
5 GAS PIPE
11 COMPRESSOR
12 FOUR-WAY VALVE
13 OUTDOOR HEAT EXCHANGER
13A FIRST OUTDOOR HEAT EXCHANGER PORT PORTION
13B SECOND OUTDOOR HEAT EXCHANGER PORT PORTION
13C OUTDOOR HEAT EXCHANGER INTERMEDIATE PORTION
14 EXPANSION VALVE
18 CONTROL CIRCUIT
31 DISCHARGE TEMPERATURE SENSOR
32 OUTDOOR HEAT EXCHANGER OUTLET PORT SENSOR
33 OUTSIDE AIR TEMPERATURE SENSOR
41 OBTAINING UNIT
43A ESTIMATION MODEL FOR COOLING
43B ESTIMATION MODEL FOR HEATING
44 CONTROL UNIT
51 INDOOR HEAT EXCHANGER
51A FIRST INDOOR HEAT EXCHANGER PORT PORTION
51B SECOND INDOOR HEAT EXCHANGER PORT PORTION

51C INDOOR HEAT EXCHANGER INTERMEDIATE PORTION

61 INDOOR HEAT EXCHANGER INTERMEDIATE SENSOR

62 INTAKE TEMPERATURE SENSOR

The invention claimed is:

1. An air conditioner having a refrigerant circuit formed by connection of an outdoor unit and an indoor unit to each other by refrigerant piping, the outdoor unit having a compressor, an outdoor heat exchanger, and an expansion valve, the indoor unit having an indoor heat exchanger, the refrigerant circuit being filled with a predetermined amount of a refrigerant, the air conditioner comprising:

a remaining refrigerant amount estimation model that estimates an amount of remaining refrigerant remaining in the refrigerant circuit by using at least rotation frequency of the compressor, refrigerant discharge temperature at the compressor, heat exchanger temperature, degree of opening of the expansion valve, and outside air temperature, of operation state quantities indicating operation states in air conditioning operation, wherein the estimate of the amount of remaining refrigerant is performed during both a heating operation and a cooling operation of the air conditioning operation, wherein the indoor heat exchanger includes:

a first indoor heat exchanger port portion where the refrigerant flows through; a second indoor heat exchanger port portion where the refrigerant flows through; an indoor heat exchanger intermediate portion connecting the first indoor heat exchanger port portion and the second indoor heat exchanger port portion to each other; and an indoor heat exchanger intermediate sensor that is provided at the indoor heat exchanger intermediate portion and detects temperature of the refrigerant passing through the indoor heat exchanger intermediate portion, the temperature being of the heat exchanger temperature, and the outdoor heat exchanger includes:

a first outdoor heat exchanger port portion where the refrigerant flow through; a second outdoor heat exchanger port portion where the refrigerant flows through; an outdoor heat exchanger intermediate portion connecting the first outdoor heat exchanger port portion and the second outdoor heat exchanger port portion to each other; and an outdoor heat exchanger outlet port sensor that is provided at the second outdoor heat exchanger port portion and detects temperature of the refrigerant passing through an outdoor heat exchanger outlet port in the second outdoor heat exchanger port portion in cooling operation, the temperature being of the heat exchanger temperature.

2. The air conditioner according to claim 1, wherein there is only one of the outdoor unit, wherein there is only one of the indoor unit, and wherein there is only one of the expansion valve.

3. The air conditioner according to claim 1, wherein the remaining refrigerant amount estimation model estimates the amount of remaining refrigerant by using an operation state quantity obtained at a time an absolute value of a difference between the refrigerant discharge temperature at the compressor and a target temperature is equal to or less than a predetermined value.

4. The air conditioner according to claim 1, wherein the remaining refrigerant amount estimation model performs machine learning using training data that are the rotation frequency of the compressor, the refrigerant discharge temperature at the compressor, the heat exchanger temperature, the degree of opening of the expansion valve, the outside air temperature, and the amount of remaining refrigerant remaining in the refrigerant circuit.

5. The air conditioner according to claim 4, wherein the remaining refrigerant amount estimation model is a linear regression equation.

6. The air conditioner according to claim 1, wherein the remaining refrigerant amount estimation model performs machine learning using training data that are results of determination of whether or not the rotation frequency of the compressor, the refrigerant discharge temperature at the compressor, the heat exchanger temperature, the degree of opening of the expansion valve, the outside air temperature, and the amount of remaining refrigerant remaining in the refrigerant circuit are normal.

7. The air conditioner according to claim 1, wherein the estimate of the amount of remaining refrigerant is performed absent a refrigerant filling operation.

8. The air conditioner according to claim 1, wherein the remaining refrigerant amount estimation model estimates the amount of remaining refrigerant remaining in the refrigerant circuit without calculating a degree of supercooling and by using at least a rotation frequency of the compressor, a refrigerant discharge temperature at the compressor, a heat exchanger temperature, a degree of opening of the expansion valve, and an outside air temperature, of operation state quantities indicating operation states in a normal operation of the air conditioner.

9. The air conditioner according to claim 8, further including a plurality of sensors for detecting each of the rotation frequency of the compressor, the refrigerant discharge temperature at the compressor, the heat exchanger temperature, the degree of opening of the expansion valve, and the outside air temperature, of the operation state quantities indicating the operation states in the normal operation of the air conditioner, wherein the plurality of sensors includes:

the indoor heat exchanger intermediate sensor that detects the temperature of the refrigerant passing through the indoor heat exchanger intermediate portion, and the outdoor heat exchanger outlet port sensor that detects, when the outdoor heat exchanger functions as a condenser, the temperature of the refrigerant passing through an outlet port of the condenser, and the air conditioner includes an extractor that extracts, according to a predetermined filtering condition, a detection result used in estimating the amount of remaining refrigerant from a result of the detecting by the plurality of sensors.

* * * * *